US007045041B2

(12) United States Patent
Katayama

(10) Patent No.: US 7,045,041 B2
(45) Date of Patent: May 16, 2006

(54) ION EXCHANGE MEMBRANE ELECTROLYZER

(75) Inventor: Shinji Katayama, Tamano (JP)

(73) Assignee: Chlorine Engineers Corp. Ltd., Tokyo (JP)

( * ) Notice: Subject to any disclaimer, the term of this patent is extended or adjusted under 35 U.S.C. 154(b) by 242 days.

(21) Appl. No.: 10/406,380

(22) Filed: Apr. 4, 2003

(65) Prior Publication Data

US 2003/0188966 A1 Oct. 9, 2003

(30) Foreign Application Priority Data

Apr. 5, 2002 (JP) ..... 2002-104168

(51) Int. Cl.
*C25B 9/10* (2006.01)
*C25B 9/20* (2006.01)

(52) U.S. Cl. ..... 204/252; 204/286.1; 204/288.3; 204/242; 204/253; 205/615

(58) Field of Classification Search ..... 204/288.4, 204/297.07, 297.14, 297.08, 297.09, 297.1, 204/254–258, 283–289, 242, 252–253, 286.1, 204/288.3; 205/615
See application file for complete search history.

(56) References Cited

U.S. PATENT DOCUMENTS

| | | | | |
|---|---|---|---|---|
| 4,374,014 | A | 2/1983 | Smith et al. | 204/260 |
| 4,389,298 | A * | 6/1983 | Pellegri | 204/288 |
| 4,444,639 | A | 4/1984 | Schurig et al. | 204/257 |
| 2002/0189936 | A1 * | 12/2002 | Shimamune | 204/242 |

FOREIGN PATENT DOCUMENTS

EP 0 568 071 A1 4/1993

OTHER PUBLICATIONS

Communication dated Nov. 24, 2003 and European Search Report.

* cited by examiner

*Primary Examiner*—Roy King
*Assistant Examiner*—Lois Zheng
(74) *Attorney, Agent, or Firm*—Westerman, Hattori, Daniels & Adrian, LLP

(57) ABSTRACT

The invention provides an ion exchange membrane electrolyzer. An electric current is passed through at least one electrode while the electrode is in contact with a plurality of comb-like flat leaf spring tags extending at an angle from a flat leaf spring form of retainer member located on an electrode partition provided in an electrode chamber. Each pair of comb-like flat leaf spring tags are arranged in such a way that adjacent flat leaf spring tags extend in mutually opposite directions.

10 Claims, 10 Drawing Sheets

(A)

(B)

(C)

(D)

PRIOR ART

PRIOR ART

ION EXCHANGE MEMBRANE ELECTROLYZER

BACKGROUND OF THE INVENTION

The present invention relates generally to an ion exchange membrane electrolyzer, and more particularly to an ion exchange membrane electrolyzer that can space electrodes away from each other at a given spacing.

In an electrolyzer used for electrolysis of an aqueous solution, the voltage required for electrolysis depends on various factors. In particular, the anode-to-cathode spacing has some considerable influences on electrolyzer voltage. One conventional approach to keeping the energy consumption necessary for electrolysis low is to cut down the spacing between electrodes, thereby dropping electrolyzer voltage.

In an ion exchange membrane electrolyzer or the like used for electrolysis of brine, three members, i.e., an anode, an ion exchange membrane and a cathode are located in a close contact manner to lower electrolyzer voltage. For a large electrolyzer having an electrode area of as large as a few square meters, wherein the anode and cathode are coupled to the respective chambers by means of rigid members, however, it is still difficult to bring both the electrodes in close contact with the ion exchange membrane, thereby cutting down the inter-electrode distance and keeping it at a given small value.

To solve this problem, an electrolyzer has been proposed, wherein a flexible member is used for at least one of the anode and cathode thereby making the inter-electrode spacing adjustable.

Various electrolyzers using flexible members as the means for cutting down the inter-electrode spacing have been proposed in the art, and electrodes with a flexible member located on an electrode substrate have been put forward as well, said flexible member comprising woven fabrics, non-woven fabrics, networks or the like fabricated of small-gauge metal wires.

These electrodes have flexible members formed of small-gauge metal wires, and so problems therewith are that when the electrode is excessively forced by reverse pressure from the opposite electrode, it is partly deformed resulting in an uneven inter-electrode spacing or the small-gauge wires are impaled into the ion exchange membrane.

An electrolyzer wherein an electrical connection is made between an electrode chamber partition and an electrode by means of a number of flat leaf spring members has been proposed in JP(A)57-108278 and JP(A)58-37183.

FIGS. 10(A), 10(B) and 10(C) are illustrative of a prior art electrolyzer comprising a flat leaf spring member.

FIG. 10(A) is a partly sectioned view of a conventional ion exchange membrane electrolyzer using a flat leaf spring member; FIG. 10(B) is a plan view of the flat leaf spring member; and FIG. 10(C) is a sectional view of that flat leaf spring member.

In an electrolyzer 51, an anode rib 56 and a cathode rib 57 are joined to an anode chamber partition 55 for an anode chamber 52 and a cathode chamber partition 54 for a cathode chamber 53 at a given spacing, respectively. An anode mount substrate 58 is attached to the anode rib 56, and an anode 59 is attached to the anode mount substrate 58.

The cathode rib 57 is provided with a cathode retainer member 61 having a number of flat leaf spring tabs 60 to retain a cathode 62 by the flat leaf spring tabs 60. Accordingly, even when the inter-electrode spacing is cut down, it is unlikely that large force is applied to an ion exchange membrane 63 between the anode 59 and the cathode 62.

Flexible electrodes using flat leaf spring tabs are superior to those using small-gauge wire members or the like in terms of behavior leading to partial deformation upon forced; however, all such flat leaf spring tabs in these electrolyzers extend from a flexible cathode retainer member at an angle in the same direction.

Upon the application of force from an electrode surface side, the force acts on the electrode surface to cause displacements of the flat leaf spring tags and move them in one direction along which the spring material is deformed, possibly resulting in misalignment of the flat leaf spring tags with the electrode, and damage to an ion exchange membrane upon such electrode misalignment when the electrode is in contact with the ion exchange membrane.

The present invention relates to an electrolyzer in which electrodes and a collector are coupled together by flexible electric current feeding means. A primary object of the present invention is to provide an electrolyzer in which even an electrode surface having a large area is smoothly retained to prevent displacement of the electrode in any direction by flexible electric current feeding means or application of excessive pressure on an ion exchange membrane surface in the case of an ion exchange membrane electrolyzer.

SUMMARY OF THE INVENTION

Figure 1:
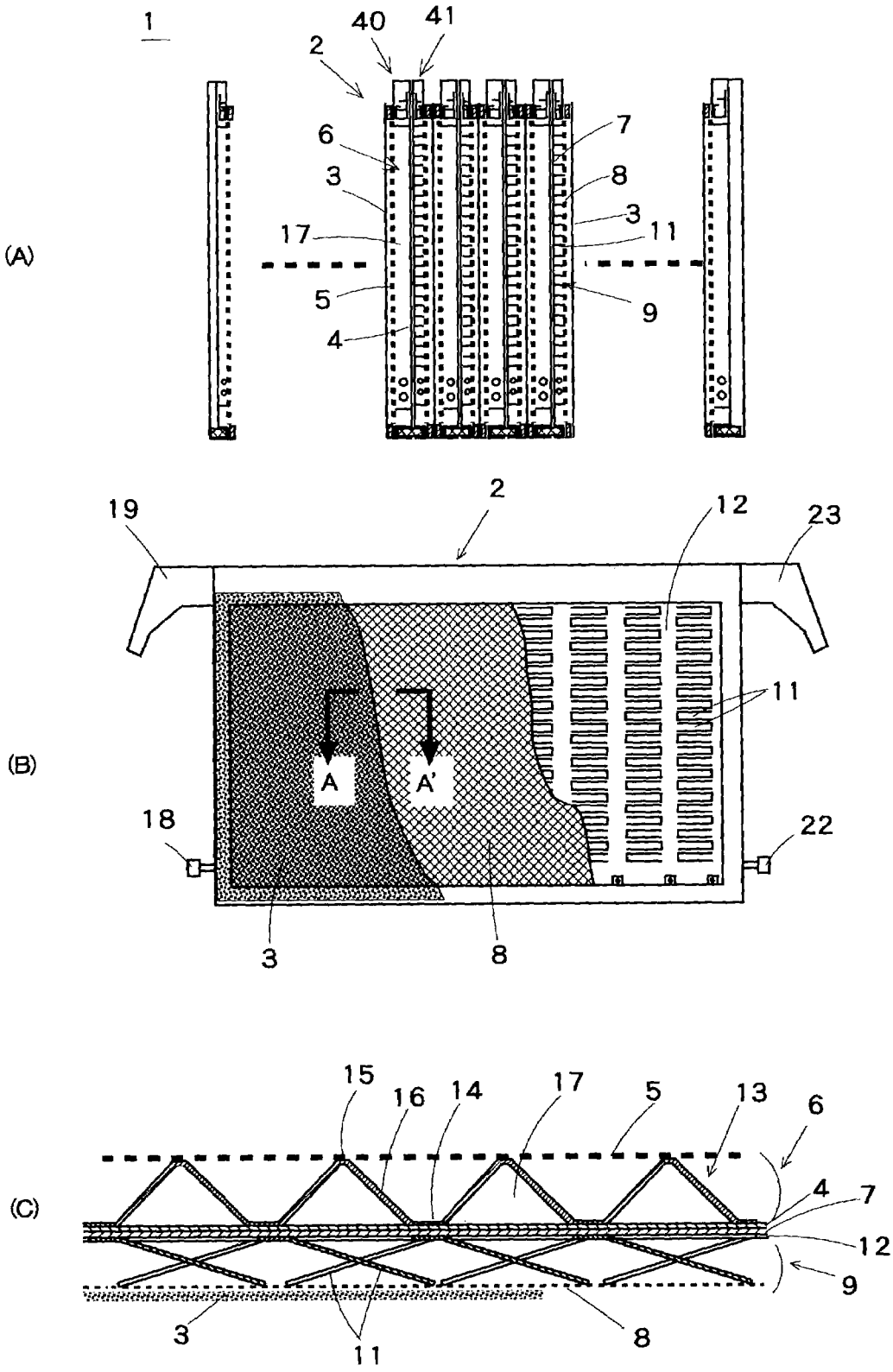
FIGS. 1(A), 1(B) and 1(C) are illustrative of one embodiment of the electrolyzer according to the present invention.

The present invention provides an ion exchange membrane electrolyzer, in which an electric current is passed through at least one electrode while said electrode is in contact with a plurality of comb-like flat leaf spring tags extending at an angle from a flat leaf spring form of retainer member located on an electrode partition provided in an electrode chamber, wherein each pair of comb-like flat leaf spring tags are arranged in such a way that adjacent flat leaf spring tags extend in mutually opposite directions.

In one specific embodiment of the present invention, each pair of comb-like flat leaf spring tags extending in mutually opposite directions have the same length.

In another specific embodiment of the present invention, the flat leaf spring tags comprises abutments bent at tips toward the flat leaf spring form of retainer member, which abutments are in contact with the electrode.

In yet another specific embodiment of the present invention, openings are found on a surface of the flat leaf spring form of retainer member onto which a comb-like flat spring tag arrangement is projected, and a land portion of the retainer member is found on a surface of the retainer member onto which adjacent flat spring tags are projected.

In a further specific embodiment of the present invention, openings are found on a surface of the flat leaf spring form of retainer member onto which a comb-like flat spring tag arrangement is projected, and a land portion of the retainer member is found on a surface of the retainer member onto which adjacent sets of flat leaf spring tags are projected.

In a further specific embodiment of the present invention, the flat leaf spring form of retainer member is joined at a belt-like junction to a flat plate form of electrode chamber partition in a parallel relation thereto, thereby defining a space between the retainer member and the electrode chamber partition. The space is used as a downward flow path for an electrolyte, and an upward flow path for the electrolyte is formed on an electrode side.

In a further specific embodiment of the present invention, the flat leaf spring form of retainer member with the flat leaf spring tags attached thereto is joined to a porous member having an opening whose diameter is larger than the electrode that the flat leaf spring tags contact.

DESCRIPTION OF THE PREFERRED EMBODIMENT

The present invention provides an electrolyzer in which a plate with flat leaf spring tags attached thereto is arranged with a flat plate form of partition or collector, etc. The flat leaf spring tags are arranged in such a way that they extend in mutually opposite directions. Thus, when the surface of an electrode is urged on the flat leaf spring tags, it is possible to keep the electrode and the opposite electrode at a given spacing without causing any lateral displacement of the electrode.

This ensures that there is no risk of damage to an ion exchange membrane in contact with the surface of the electrode, etc., and even an electrode having a large area is located at any desired distance from the opposite electrode or ion exchange membrane.

The present invention is now explained more specifically with reference to the accompanying drawings. FIGS. 1(A), 1(B) and 1(C) are illustrative of one embodiment of the presently invented electrolyzer. FIG. 1(A) is illustrative in section of the ion exchange membrane electrolyzer made up of a stacking arrangement comprising a plurality of electrolyzer units, FIG. 1(B) is a plan view of an electrolyzer unit as viewed from a cathode side, and FIG. 1(C) is a sectional view taken on line A–A' of FIG. 1(B).

As shown in FIG. 1(A), an ion exchange membrane electrolyzer generally indicated by 1 is built up of a plurality of bipolar electrolyzer units 2 that are stacked one upon another via an ion exchange membrane 3.

Each electrolyzer unit 2 is provided with an anode 5 spaced away from an anode chamber partition 4 to form an anode chamber 6. A cathode 8 is spaced away from a cathode chamber partition 7 while a cathode chamber 9 is formed between the cathode chamber partition 7 and the ion exchange membrane 3.

The anode and cathode chambers 6 and 9 are provided on their tops with an anode chamber side gas/liquid separation means 40 and a cathode chamber side gas/liquid separation means 41, respectively.

An anode fluid feed pipe 18 is attached to the anode chamber 6 in the electrolyzer unit 2, and the anode chamber side gas/liquid separation means 40 is provided with an anode fluid discharge pipe 19 for discharging an anode fluid with decreased concentration and gases.

Similarly, a cathode fluid feed pipe 22 is attached to the cathode chamber 9 in the electrolyzer unit 2, and the cathode chamber side gas/liquid separation means 41 is provided with a cathode fluid discharge pipe 23 for discharging a cathode fluid with decreased concentration and gases.

While both the anode fluid feed pipe and the anode fluid discharge pipe are located on the same side as shown, it is acceptable to locate the feed pipe in opposition to the discharge pipe or, alternatively, locate the anode fluid feed pipe and the cathode fluid feed pipe on the same side.

As shown in FIGS. 1(B) and 1(C), a flat leaf spring form of retainer member 12 is attached to the cathode chamber partition 7, and has plural pairs of comb-like flat leaf spring tags 11 that extend at an angle from the retainer member 12, so that the cathode 8 comes in electrically conductive contact with the tips of the tags. In each pair of comb-like flat leaf spring tags, the adjacent flat leaf spring tags extend from the retainer member 12 in mutually opposite directions. The ion exchange member 3 is applied over the surface of the cathode 8.

The cathode 8 comes into contact with the flat leaf spring tags 11 that extend from the retainer member 12 in mutually opposite directions; only force in a vertical direction to the cathode chamber partition acts on the cathode. Consequently, the repulsion of the flat leaf spring tags 11 causes the cathode to be displaced in a direction at right angles with the cathode chamber partition 7 and, hence, makes the cathode 8 unlikely to move parallel with the cathode chamber partition 7. It is thus possible to regulate the cathode to a given position without posing problems such as damage to the ion exchange membrane surface.

As shown in FIGS. 1 (B) and 1 (C), joined to the cathode chamber partition 7 is the flat leaf spring form of retainer member 12 that comprises a plate-like member with a number of flat leaf spring tags 11 being located thereon in such a way that pairs of mutually opposite, comb-like flat leaf spring tags 11 extend from the retainer member 12. The cathode 8 is located in contact with the tips of the flat leaf spring tags 11, and the ion exchange membrane 3 is applied over the surface of the cathode 8.

The cathode 8 comes into contact with the flat leaf spring tags 11 that extend from the flat leaf spring form of retainer member 12 in mutually opposite directions; only force in a vertical direction to the cathode chamber partition acts on the cathode. Consequently, the repulsion of the flat leaf spring tags 11 causes the cathode to be displaced in a direction perpendicular to the cathode chamber partition 7 and, hence, makes the cathode 8 unlikely to move parallel with the cathode chamber partition 7. It is thus possible to regulate the cathode to a given position without posing problems such as damage to the ion exchange membrane surface.

It is preferable that the pair of mutually opposite, comb-like flat leaf spring tags extending from the retainer member 12 have the same length. This is because when force is applied to the flat leaf spring tags, the lengths of the portions of contact with the electrode surface become large uniformly throughout the pairs of flat leaf spring tags, so that the distribution of sites of the electrode surface through which electric currents are passed is made uniform.

On the other hand, an arrangement comprising each pair of mutually opposite, comb-like flat leaf spring tags without extending mutually from the retainer member is not preferable because when force is applied to the electrode surface, the lengths of the portions of contact with the electrode surface become short and so the distribution of currents directed to the electrode becomes non-uniform.

The flat leaf spring form of retainer member 12 attached to the cathode chamber partition may be constructed of one single member having the same area as that of the cathode surface or a given number of members.

On the other hand, an anode retainer member 13 is joined to the anode chamber partition 4 at a belt-like junction 14 at which the anode chamber partition 4 comes into close contact with the anode retainer member 13. It is not always required to weld the anode chamber partition 4 continuously all over the anode retainer member 13; in other words, it is acceptable to join both together at a number of spot welding sites so that the anode retainer member 13 comes into close contact with the anode chamber partition 4 thereby ensuring an electrically conductive connection between both while a space formed between both is isolated from the opposite space.

A projecting strip 15 is formed between adjacent belt-like junctions 14 of the anode retainer member 13, and the projecting strip 15 is joined to each junction 14 by way of a planar portion 16. The anode 5 is joined to the projecting strip 15 at plural sites.

The projecting strip 15 should preferably have a width large enough to ensure that the electrode can be joined to an apex portion thereof. For instance, the projecting strip may be formed by bending a metal sheet in a triangular form or in such a way that the electrode retainer member forms a plane parallel with the partition. The anode retainer member may be formed as a separate member or a member of mutually joined pieces may be formed by press molding. Alternatively, all anode retainer members located at the anode chamber partition may be prepared by forming one metal sheet.

The junction 14 and the projecting strip 15 joined together by way of the planar portion 16 provide a truss section that improves on the rigidity of the anode chamber formed of a thin sheet.

The anode retainer member 13, the anode chamber partition 4 and the adjacent belt-like junctions 14 create together a space that defines an anode fluid-circulating path 17. A mixed gas-liquid fluid goes up in a space on the side of the surface of the anode retainer member 13 facing the anode 5 and arrives at an upper portion of the anode chamber where the gas is separated from the fluid. A part of the thus separated electrolyte is discharged through an anode fluid discharge pipe 19. Then, the fluid goes down through the anode fluid-circulating path 17 and arrives at a bottom portion of the anode chamber, from which it flows into a space on the anode surface side. Then, the fluid is mixed with an anode fluid supplied and injected from an anode fluid supply pipe 18 attached to the electrolyzer into the anode chamber for electrolysis at the anode.

Figure 2:
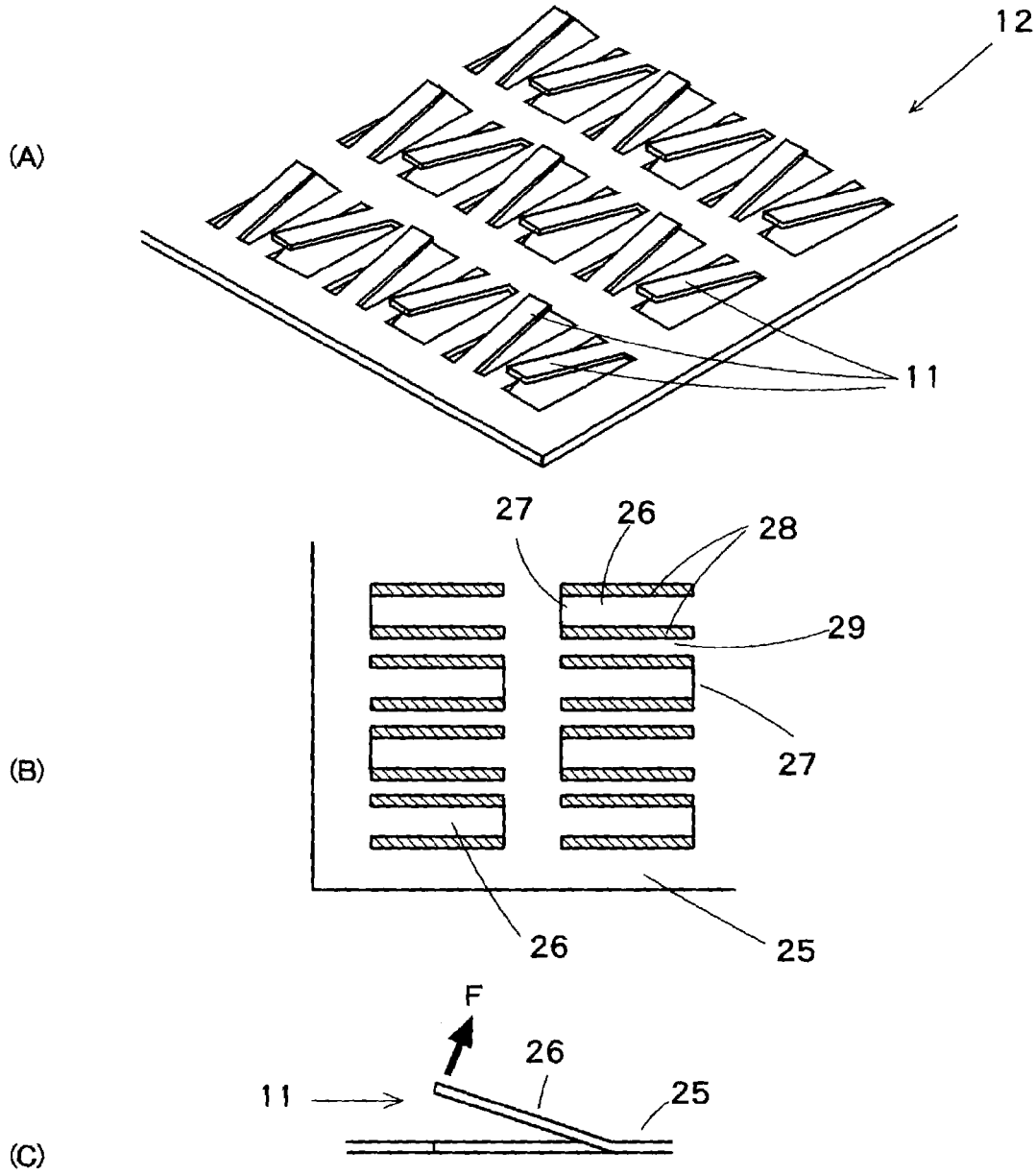
FIGS. 2(A), 2(B) and 2(C) are illustrative of one embodiment of the flat leaf spring tag arrangement according to the present invention.
Figure 3:
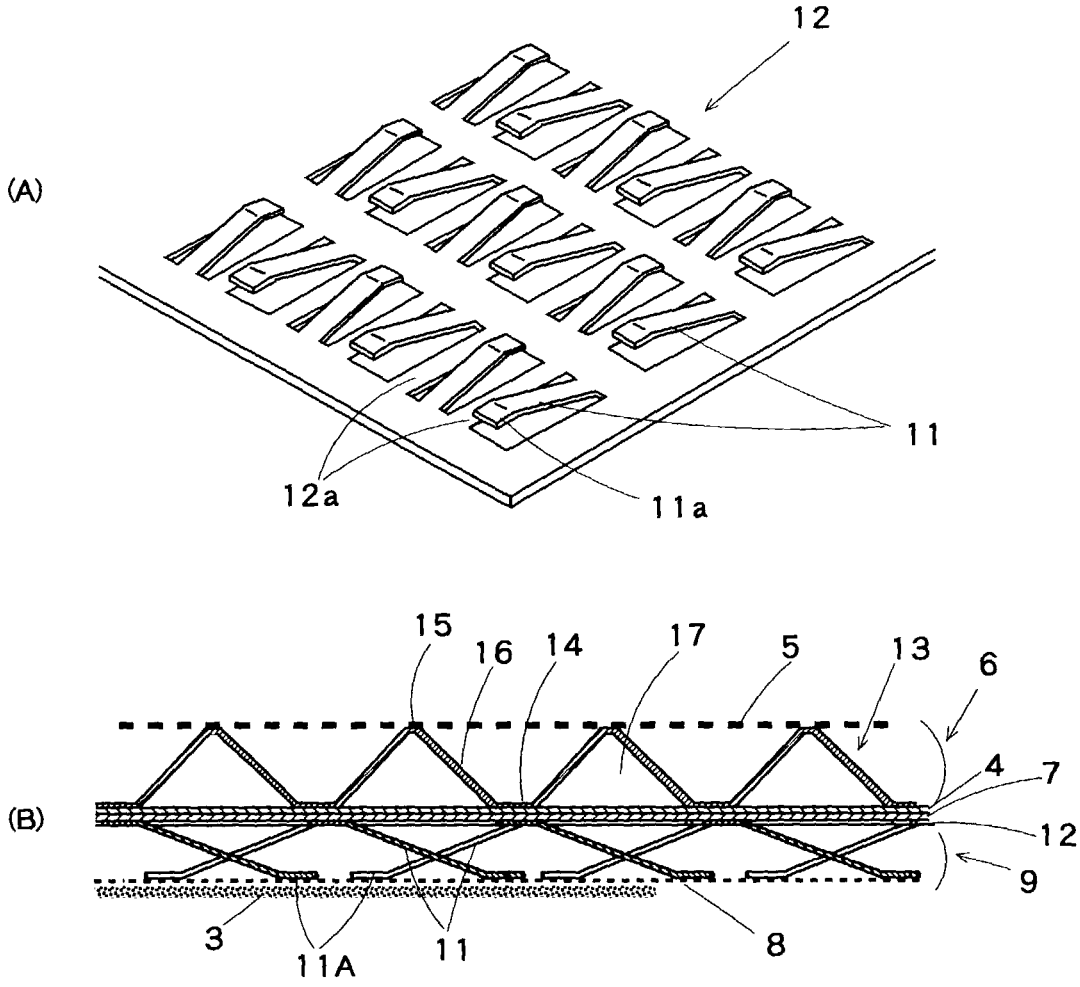
FIGS. 3(A) and 3(B) are illustrative of another embodiment of the flat leaf spring tag arrangement according to the present invention.

FIGS. 2(A), 2(B) and 3(C) are illustrative of the flat leaf spring tags according to the present invention.

FIG. 2(A) is a perspective view of the tags, FIG. 2(B) is a plan view illustrative of one process of fabricating the tags, and FIG. 2(C) is illustrative in section of that process.

As depicted in FIG. 2(A), the flat leaf spring form of retainer member 12 is provided with plural pairs of comb-like flat leaf spring tags 11 that extend at an angle therefrom. Three pairs of comb-like tags are shown. The adjacent flat leaf spring tags 11 forming each pair of comb-like tags extends from the retainer member 12 in mutually opposite directions.

Although the flat leaf spring tag 11 may be fabricated by joining to a flat plate by any suitable means, it is understood that the tag can easily be prepared by cutting a plate material as described below and then raising a tag piece in one direction.

As shown in FIG. 2(B), a flat plate 25 is cut along a cutting line to delineate a portion 26 for forming a flat leaf spring tag, and the portion 26 is punched out to form an opening 28 while that portion 26 is left. Then, force F is applied to the portion 26 as shown in FIG. 2(C) to raise the portion 26 in one direction, thereby forming a flat leaf spring tag 11.

A land portion 29 is left between openings 28 formed between the portions 26 where the flat leaf spring tags are formed, so that when the flat leaf spring tag is projected onto the flat leaf spring form of retainer member, the retainer member is found between a space between the adjacent flat leaf spring tags. Portions of the retainer member found in the spaces between the flat leaf spring tags serve to enhance the rigidity of the retainer member 12, and make the movement of the cathode in contact with the tags 11 smoother.

It is not always required to locate land portions 29 between all openings 28; the number of land portions may be determined with the rigidity of the member, etc. in mind.

FIGS. 3(A) and 3(B) are illustrative of another embodiment of the flat leaf spring tags according to the present invention.

FIG. 3(A) is a perspective view of flat leaf spring tags, and FIG. 3(B) is illustrative in horizontal section of an electrode chamber in an electrolyzer using an arrangement of flat leaf spring tags shown in FIG. 3(A).

A flat leaf spring form of retainer member 12 is provided with plural pairs of comb-like flat leaf spring tags 11 that extend at an angle therefrom. Three pairs of comb-like tags are shown. The adjacent flat leaf spring tags 11 forming each pair of comb-like tags extend in mutually opposite directions.

Each flat leaf spring tag 11 is provided at its tip in contact with the electrode with an abutment 11A that is bent substantially parallel with the retainer member 12, said abutment 11A being in contact with the electrode.

When, as shown in FIG. 3(B), the cathode side of the cathode chamber 9 is provided with the flat leaf spring form of retainer member 12 having the flat leaf spring tags 11 with their tips bent substantially parallel therewith to form the abutments 11A in contact with the electrode, the movement of the cathode 8 and the spring tags 11 becomes smooth at a reduced spacing between the cathode 8 and the retainer member 12, so that the inter-electrode spacing can smoothly be adjusted to ensure the electrical connection between the electrode and the flat leaf spring tags.

FIGS. 4(A), 4(B), 4(C) and 4(D) are illustrative of another embodiment of the flat leaf spring tags according to the present invention.

Figure 4:
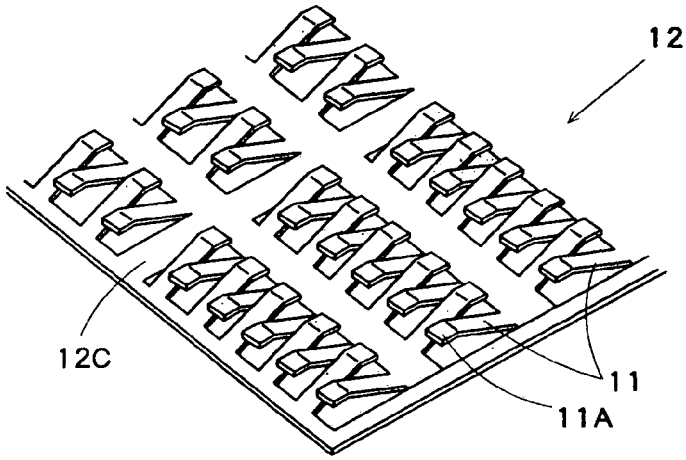
FIGS. 4(A), 4(B), 4(C) and 4(D) are illustrative of yet another embodiment of the flat leaf spring tag arrangement according to the present invention.
Figure 4:
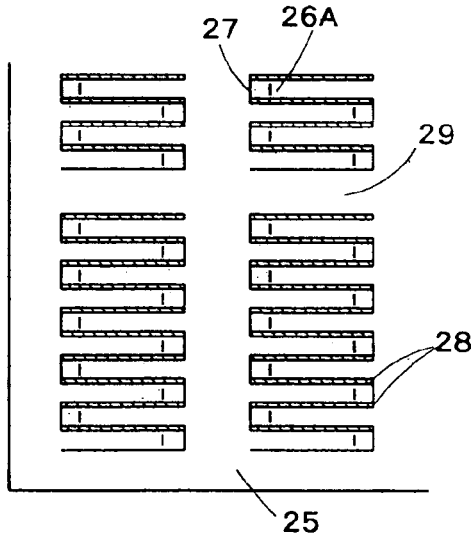
Figure 4:
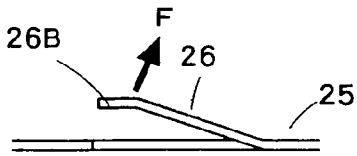
Figure 4:
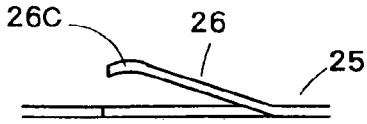

FIG. 4(A) is a perspective view of that embodiment, FIG. 4(B) is a plane view illustrative of one tag preparation process, FIG. 4(C) is a sectional view of one embodiment of each flat leaf spring tag, and FIG. 4(D) is a sectional view of another embodiment of the flat leaf spring tag.

As shown in FIG. 4(A), a flat leaf spring form of retainer member 12 is provided with plural pairs of comb-like flat leaf spring tags 11 extending at an angle therefrom. Three pairs of comb-like tags are shown. The adjacent flat leaf spring tags 11 forming each pair of comb-like tags extend in mutually opposite directions.

As shown in FIG. 4(B), a flat plate 25 is cut along a cutting line to delineate portions 26 where flat leaf spring tags are to be formed, and punched out to form openings 28 while leaving those portions 26. Each portion 26 is notched with a folding line 26A to provide the tip of a flat leaf spring tag with an abutment.

As shown in FIG. 4(C), force F is applied to the portion 26 where the flat leaf spring tag is to be formed, so that the portion 26 is raised from the flat plate 25 in one direction to form the flat leaf spring tag. An abutment 26B is bent along the folding line 26A in such a way as to extend parallel with the flat plate 25.

As shown in FIG. 4(D), it is acceptable to form an abutment 26C having a curved surface, using the folding line 26A.

When the flat leaf spring tags are projected onto the flat leaf spring retainer member, between adjacent sets of flat leaf spring tags there is found a strength holding land 12C. In one embodiment shown in FIG. 4(A), the strength holding land 12C is provided every five sets of flat leaf spring tags 11 extending in mutually opposite directions from the flat leaf spring form of retainer member 12, thereby enhancing the rigidity of the retainer member 12. The strength holding lands 12C are provided at a space that may be determined with the rigidity of the retainer member, etc. in mind.

By locating the strength holding lands 12C at a given space, it is possible to ensure much more portions of contact of the electrode with the flat leaf spring tags for each unit area as compared with the embodiment of FIGS. 3(A) and 3(B), thereby reducing electrical losses in association with an increase in the amount of electric currents.

The flat leaf spring form of retainer member having flat leaf spring tags may be continuously prepared by cutting and punching-out of a retainer member blank from a plate material and bending of the retainer member blank with a press machine.

Figure 5:
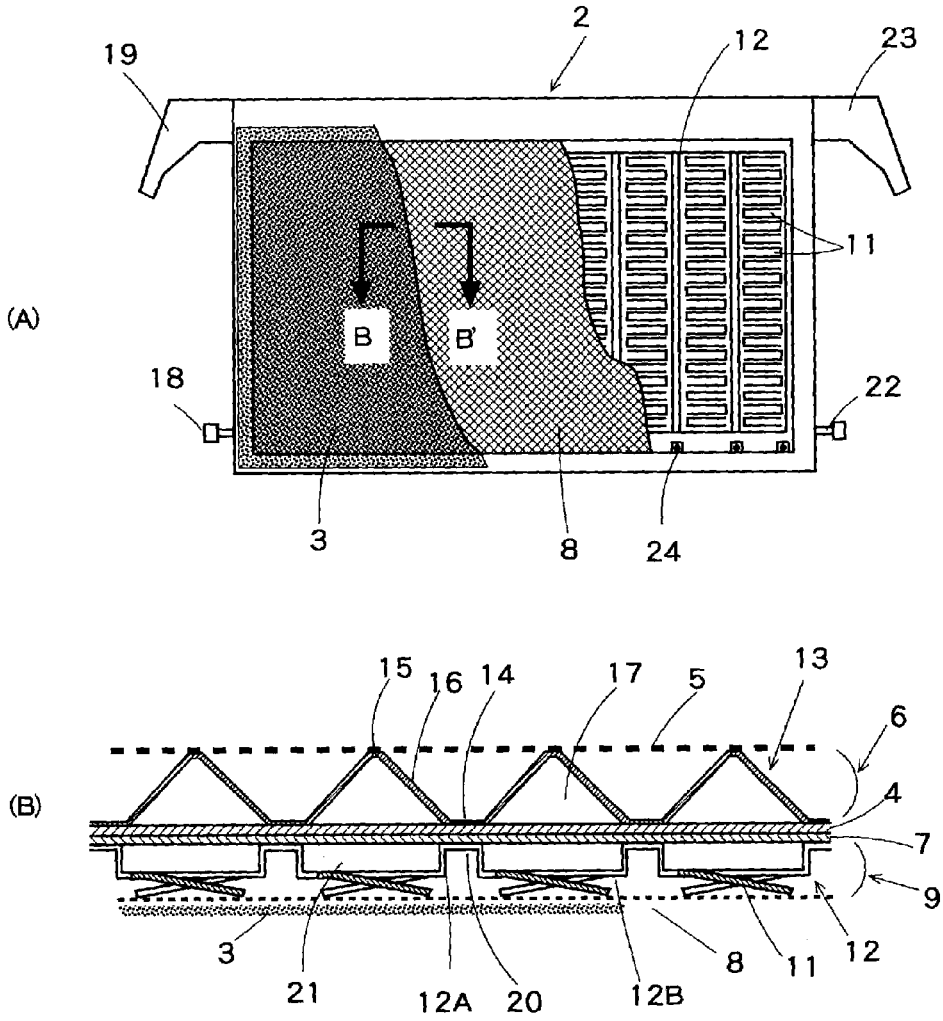
FIGS. 5(A) and 5(B) are illustrative of another embodiment of the electrolyzer according to the present invention.

FIGS. 5(A) and 5(B) are illustrative of another embodiment of the electrolyzer according to the present invention. FIG. 5(A) is a partly cut-away schematic of the electrolyzer as viewed from its cathode side, and FIG. 5(B) is a sectional view taken on line B–B' of FIG. 5(A).

A bipolar type electrolyzer unit 2 for an ion exchange membrane electrolyzer is built up of an anode chamber 6 and a cathode chamber 9, and a flat plate anode chamber partition 4 is joined to a flat plate cathode chamber partition 7 in an electrically and mechanically integrated fashion.

The cathode chamber partition 7 is provided with a flat leaf spring form of retainer member 12 comprising a number of flat leaf spring tags 11 located in a comb-like pattern wherein plural pairs of comb-like flat leaf spring tags extend in mutually opposite directions from the retainer member 12. In this state, electric currents are passed through the resulting arrangement. In each pair of comb-like flat leaf spring tags, the adjacent flat leaf spring tags extend in mutually opposite directions.

The flat leaf spring of retainer member 12 is joined at a belt-like junction 20 to the cathode chamber partition 7, so that the cathode chamber partition 7 comes in close contact with the flat leaf spring form of retainer member 12 at that belt-like junction 20. The flat leaf spring form of retainer member 12 is made up of a longitudinal portion 12A connected to the junction 20 and a lateral portion 12B that intersects at right angles with the longitudinal portion 12A and extends parallel with the cathode chamber partition 7. The lateral portion 12B is provided with comb-like flat leaf spring tags 11 extending in mutually opposite directions to form a cathode fluid-circulating path 21 between the retainer member 12 and the cathode chamber partition 7.

Consequently, a mixed gas/liquid fluid going up in a space defined on the surface side of the cathode 8 is separated into gases and liquids at a top portion of the cathode chamber. A part of the thus separated electrolyte is discharged from the electrolyzer by way of a cathode fluid discharge pipe 23, and another part goes down through the cathode fluid-circulating path 21, arriving at a bottom portion of the cathode chamber, from which the fluid flows into the space on the cathode surface side. That fluid is then mixed with a cathode fluid fed from a cathode fluid feed pipe 22 provided at the electrolyzer and injected from a cathode fluid feed port 24 into the cathode chamber for electrolysis at the cathode.

In this way, the circulation of the electrolyte in the cathode chamber is so promoted that the concentration distribution of the cathode fluid can reduce, resulting in efficient electrolysis.

On the other hand, an anode retainer member 13 is joined to the anode chamber partition 4 at a belt-like junction 14, so that the anode chamber partition 4 and the anode retainer member 13 are joined together at the belt-like junction 14 in a closed contact manner.

A projecting strip 15 is formed between the adjacent belt-like junctions 14 of the anode retainer member 13, and the projecting strip 15 is joined to each belt-like junction 14 by way of a planar portion 16. An anode 5 is joined to the projecting strip 15 at a plurality of sites.

The anode retainer member 13, the anode chamber partition 4 and the adjacent belt-like junction 14 create together a space in which there is provided an anode fluid-circulating path 17.

A mixed gas/liquid fluid going up in a space defined on the side of the anode retainer member 13 that faces the surface of the anode 5 is separated into gases and liquids at a top portion of the anode chamber. A part of the thus separated electrolyte flows out by way of an anode fluid discharge pipe 19. That electrolyte then goes down through the cathode fluid-circulating path 17, arriving at a bottom portion of the anode chamber, from which the fluid flows into the space on the anode surface side. That fluid is then mixed with an anode fluid fed from an anode fluid feed pipe 18 provided at the electrolyzer and injected into the anode chamber for electrolysis at the anode surface.

Figure 6:
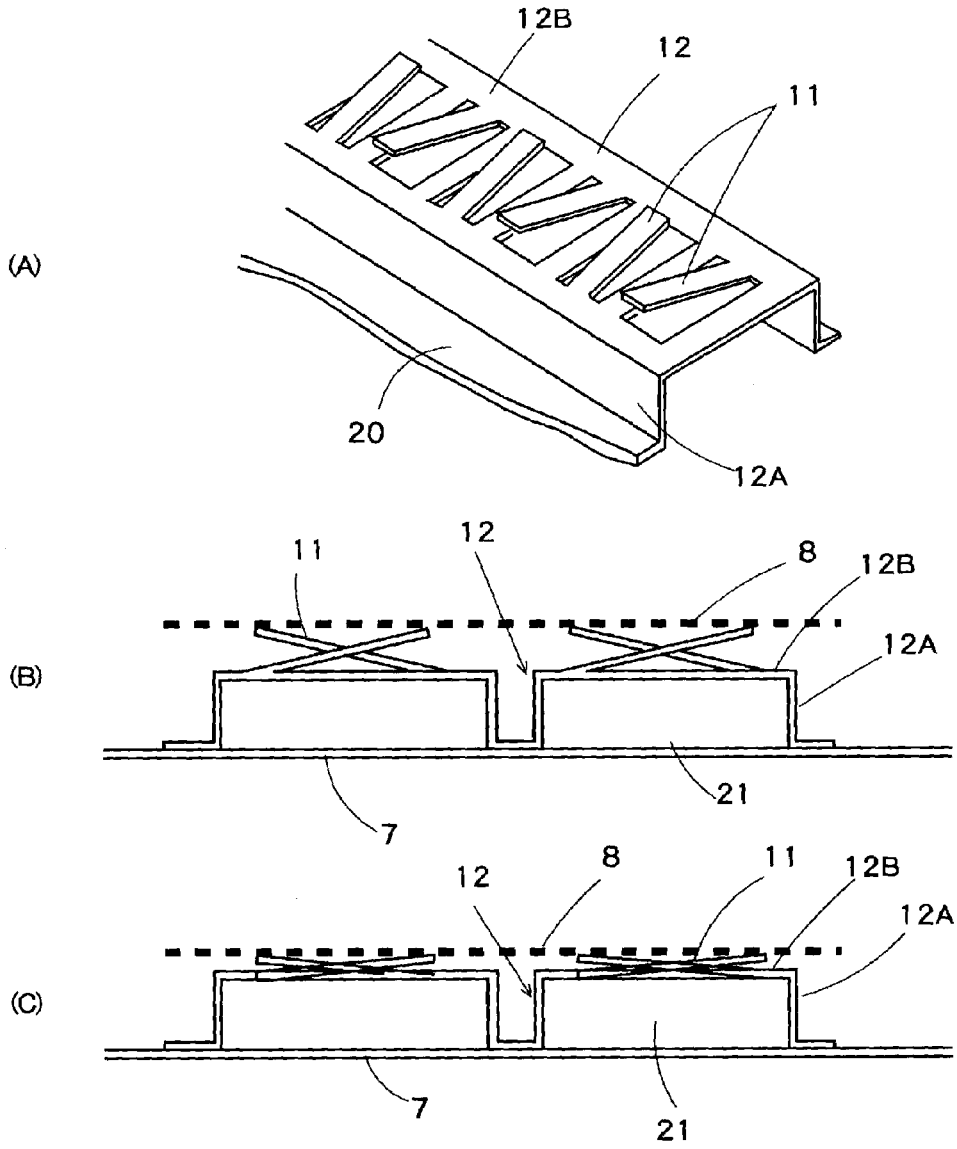
FIGS. 6(A), 6(B) and 6(C) are illustrative of the flat leaf spring form of retainer member shown in FIGS. 5(A) and 5(B).

FIGS. 6(A), 6(B) and 6(C) are illustrative of the flat leaf spring form of retainer member shown in FIGS. 5(A) and 5(B). FIG. 6(A) is a perspective view of the flat leaf spring form of retainer member, and FIGS. 6(B) and 6(C) are illustrative in section of that retainer member attached to an electrolyzer.

Comprising a junction 20 with the cathode chamber partition, a flat leaf spring form of retainer member 12 is made up of a longitudinal portion 12A connected to the junction and a lateral portion 12B that intersects at right angles with the longitudinal portion and extends parallel with the cathode chamber partition. The lateral portion 12B is provided with a pair of comb-like flat leaf spring tags 11 extending in mutually opposite directions. The longitudinal and lateral portions 12A and 12B of the flat leaf spring retainer member 12 create together a cathode fluid-circulating path 21 between the retainer member 12 and the cathode chamber partition 7.

Prior to the assembly of the electrolyzer, the cathode 8 is located at a position away from the cathode chamber partition 7 by the repulsive force of the flat leaf spring tags 11, as shown in FIG. 6(B). After the assembly of the electrolyzer, however, it is possible to keep the cathode 8 at a given space from the opposite electrode.

As in the case of FIGS. 2(A), 2(B) and 2(C), the retainer member 12 in a flat leaf spring form may be prepared by configuring a member with flat leaf spring tags 11 provided thereon in the form of a projecting strip member. Alternatively, that retainer member 12 may be prepared by press molding to form a projecting strip member, followed by the formation of flat leaf spring tags 11.

A given number of retainer members in a flat leaf spring form, each comprising one single projecting strip member, may be joined to the cathode chamber partition 7 in the electrolyzer. Alternatively, a given number of retainer members 12 in a flat leaf spring form, each having a plurality of projecting strip members, may be joined to the cathode chamber partition 7. Still alternatively, one single retainer member in a flat leaf spring form having the same size as the cathode chamber partition may be joined to the cathode chamber partition 7.

Figure 7:
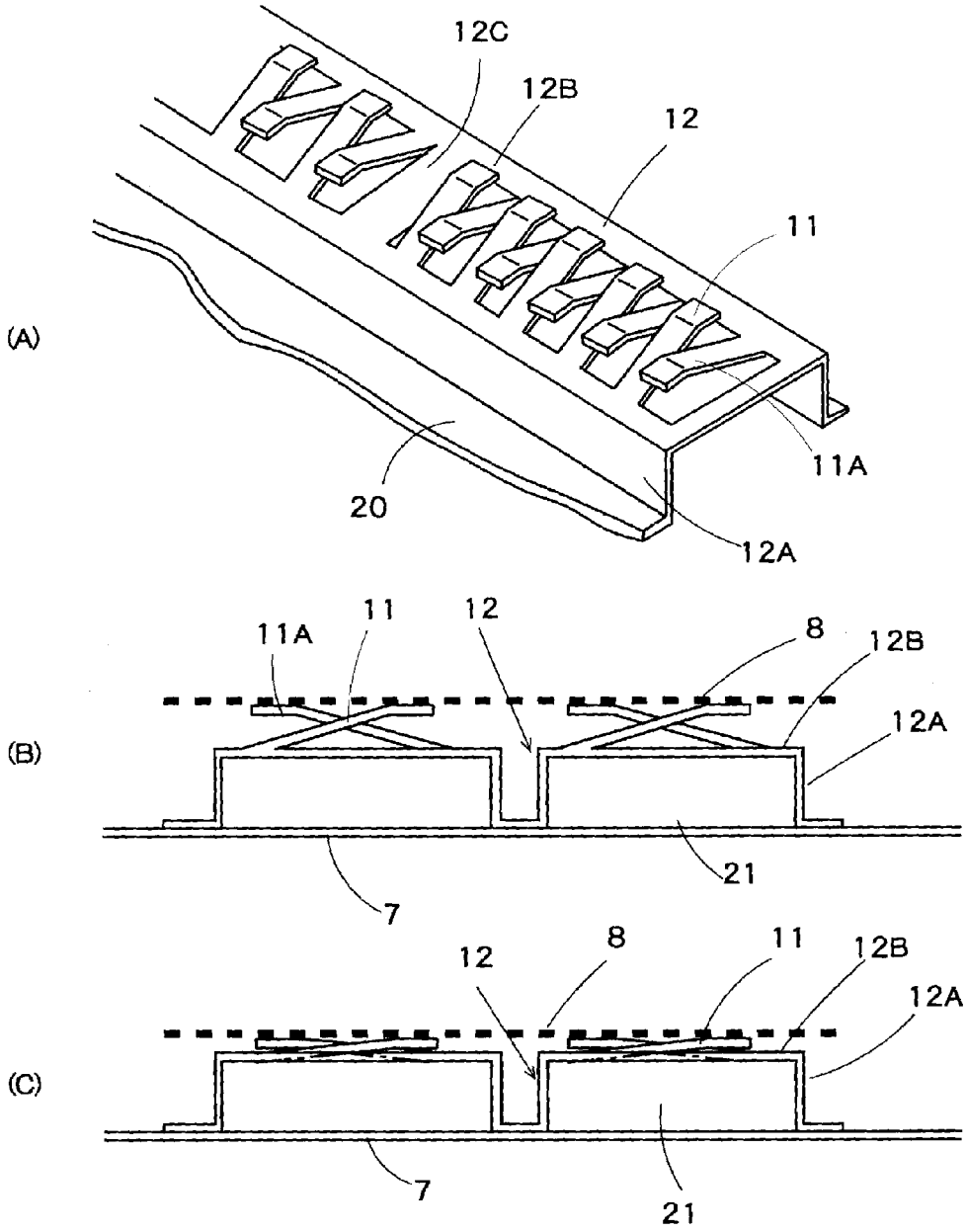
FIGS. 7(A), 7(B) and 7(C) are illustrative of another embodiment of the flat leaf spring form of retainer member according to the present invention.

FIGS. 7(A), 7(B) and 7(C) are illustrative of another embodiment of the flat leaf spring form of retainer member. FIG. 7(A) is a perspective view of the flat leaf spring form of retainer member, and FIGS. 7(B) and 7(C) are illustrative in section of that retainer member attached to an electrolyzer.

Comprising a junction 20 with the cathode chamber partition, a flat leaf spring form of retainer member 12 is made up of a longitudinal portion 12A connected to the junction and a lateral portion 12B that intersects at right angles with the longitudinal portion and extends parallel with the cathode chamber partition. The lateral portion 12B is provided with a pair of comb-like flat leaf spring tags 11 extending in mutually opposite directions. The longitudinal and lateral portions 12A and 12B of the flat leaf spring form of retainer member 12 create together a cathode fluid-circulating path 21 between the retainer member 12 and the cathode chamber partition 7.

Each flat leaf spring tag 11 is provided at its tip with an abutment 11A extending parallel with the flat leaf spring form of retainer member, so that the abutment 11A comes into contact with the electrode surface to make an electrical connection.

When the flat leaf spring tags are projected onto the flat leaf spring form of retainer member, a strength holding land 12C is found between the adjacent sets of flat leaf spring tags.

Prior to the assembly of the electrolyzer, the cathode 8 is located at a position away from the cathode chamber partition 7 by the repulsive force of the flat leaf spring tags 11 while the abutments 11A of the flat leaf spring tags 11 are in contact with the cathode 8, as shown in FIG. 7(B). After the assembly of the electrolyzer, however, the cathode 8 is held at a given space from the opposite electrode, as shown in FIG. 7(C).

As in the case of FIGS. 2(A), 2(B) and 2(C), the flat leaf spring form of retainer member 12 may be formed by press molding a flat leaf spring member blank to form a projecting strip, then cutting or otherwise forming the flat leaf spring tags, and then forming the flat leaf spring tags 11 on the projecting strip.

A given number of retainer members in a flat leaf spring form, each comprising one single projecting strip member, may be joined to the cathode chamber partition 7 in the electrolyzer. Alternatively, a given number of retainer members 12 in a flat leaf spring form, each having a plurality of projecting strip members, may be joined to the cathode chamber partition 7. Still alternatively, one single retainer member in a flat leaf spring form having the same size as the cathode chamber partition may be joined to the cathode chamber partition 7.

FIGS. 8(A), 8(B), 8(C) and 8(D) are illustrative of yet another embodiment of the present invention, showing an electrolyzer a part of which is cut away along a horizontal plane.

Figure 8:
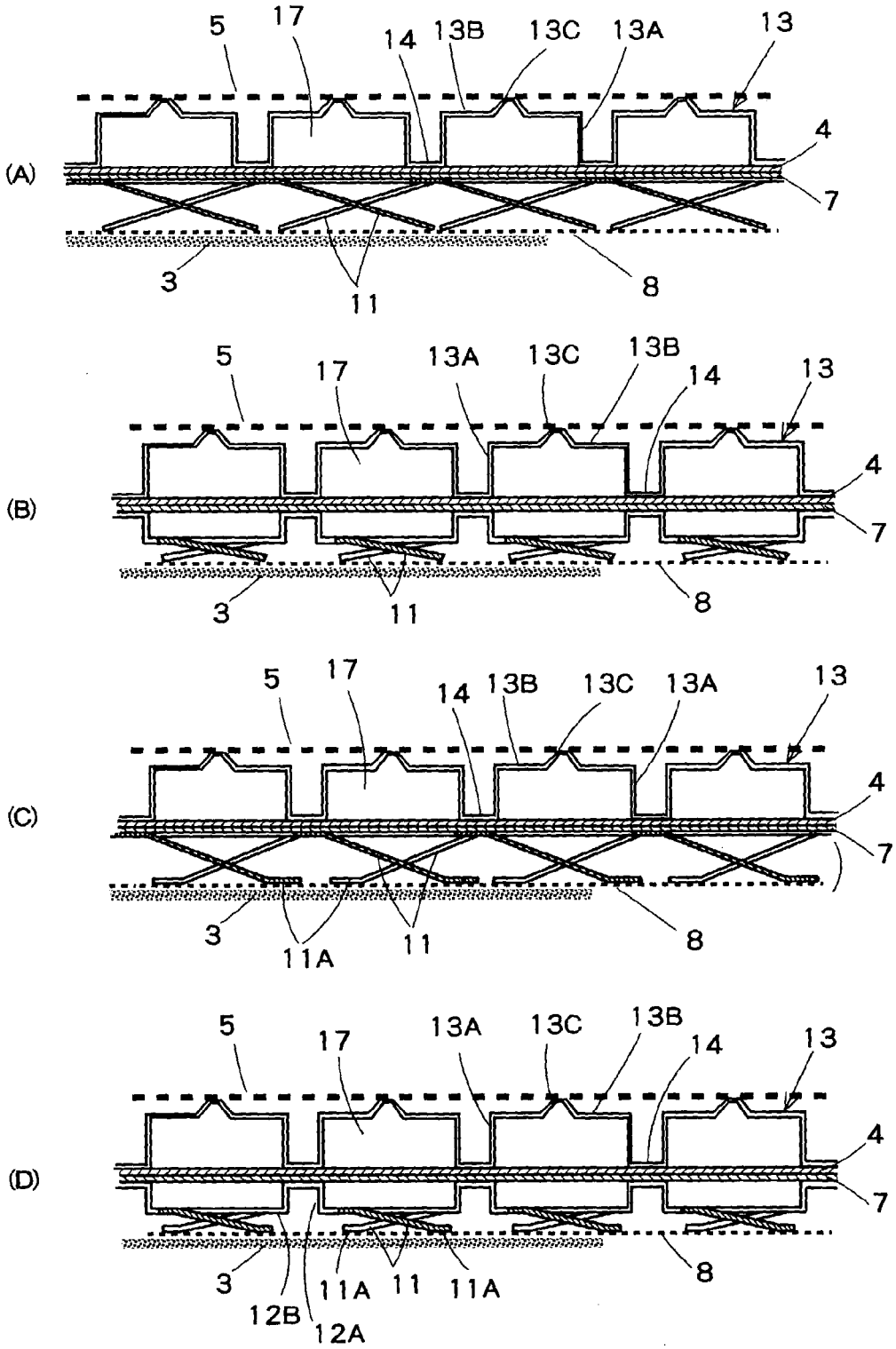
FIGS. 8(A), 8(B), 8(C) and 8(D) are illustrative of yet another embodiment of the present invention, showing sections of an electrolyzer a part of which is cut away along a horizontal plane.

An electrolyzer shown in FIG. 8(A) that is a sectional view taken on line A–A' of FIG. 1(A) is different in the structure of the anode chamber from that shown in FIGS. 1(A), 1(B) and 1(C). An electrolyzer shown in FIG. 8(B) that is a sectional view taken on line B–B' of FIG. 5(A) is different in the structure of the anode chamber from that shown in FIGS. 5(A) and 5(B). FIGS. 8(C) and 8(D) are different in the configuration of the flat leaf spring tags from FIGS. 8(A) and 8(B), respectively. These electrolyzers have a cathode chamber having the same structure as shown in FIGS. 1(C) and 5(B), respectively, and so will be explained with reference to the anode chamber alone.

In each electrolyzer, an anode retainer member 13 provided on an anode chamber partition 4 is joined to a belt-like junction 14, and made up of a longitudinal portion 13A connected to the belt-like junction 14 and a lateral portion 13B that intersects at right angles with the longitudinal portion and extends parallel with the anode chamber partition. An anode 5 is attached to a projecting strip 13C provided on the lateral portion 13B, and the longitudinal portion 13A and lateral portion 13B of the anode retainer member 13 cooperate with the anode chamber partition 4 to form an anode fluid-circulating path 17, thereby enhancing the circulation of an anode fluid.

Flat leaf spring tags 11 shown in FIGS. 8(C), and 8(D) are bent at their tips to form abutments 11A that are substantially parallel with the lateral portion 12B of the flat leaf spring form of retainer member 12. Consequently, the contact of a cathode 8 with the flat leaf spring tags 11 becomes smooth upon assembly of the electrolyzer.

While the electrolyzer of the present invention has been described with reference to some embodiments wherein the flat leaf spring form of retainer member is joined to the partition of a bipolar electrolyzer, it is understood that the inventive electrolyzer may be assembled with other collector or retainer.

Figure 9:
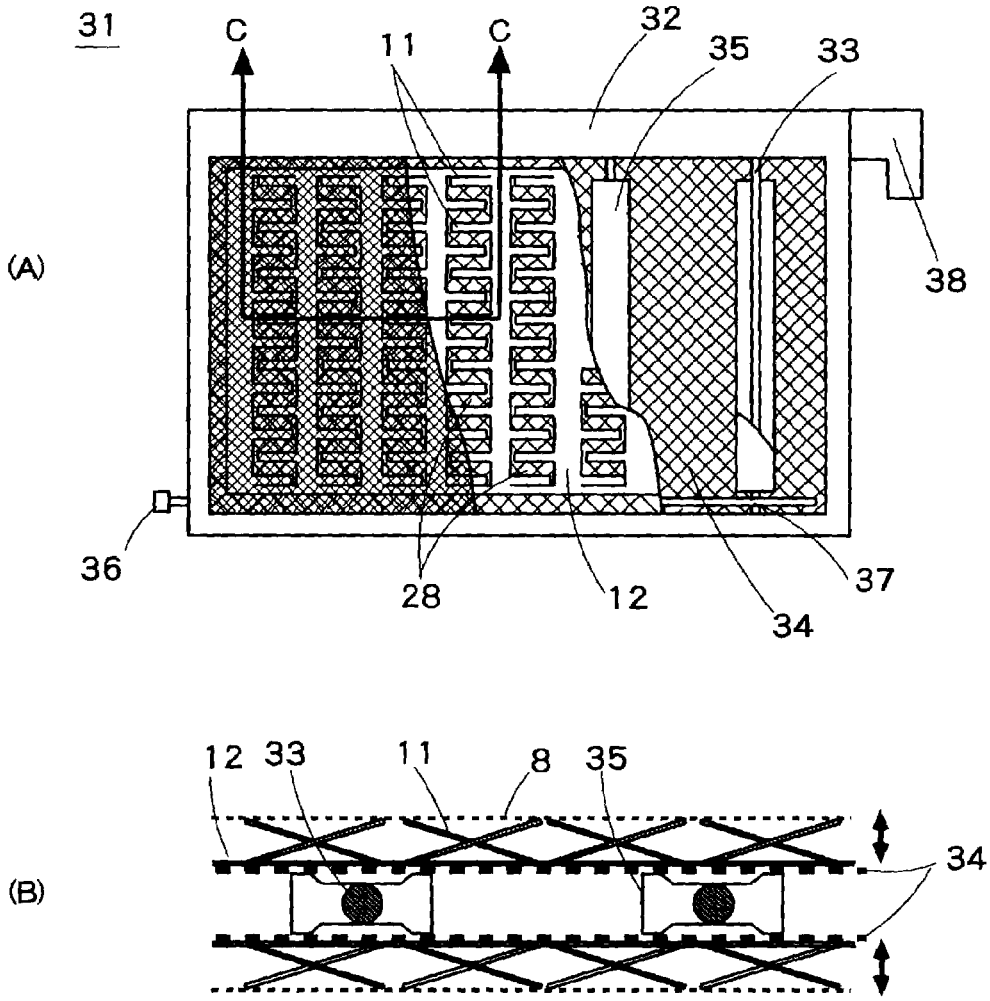
FIGS. 9(A) and 9(B) are illustrative of a further embodiment of the present invention, wherein flat leaf spring tags are provided to a unipolar electrolyzer.
Figure 10:
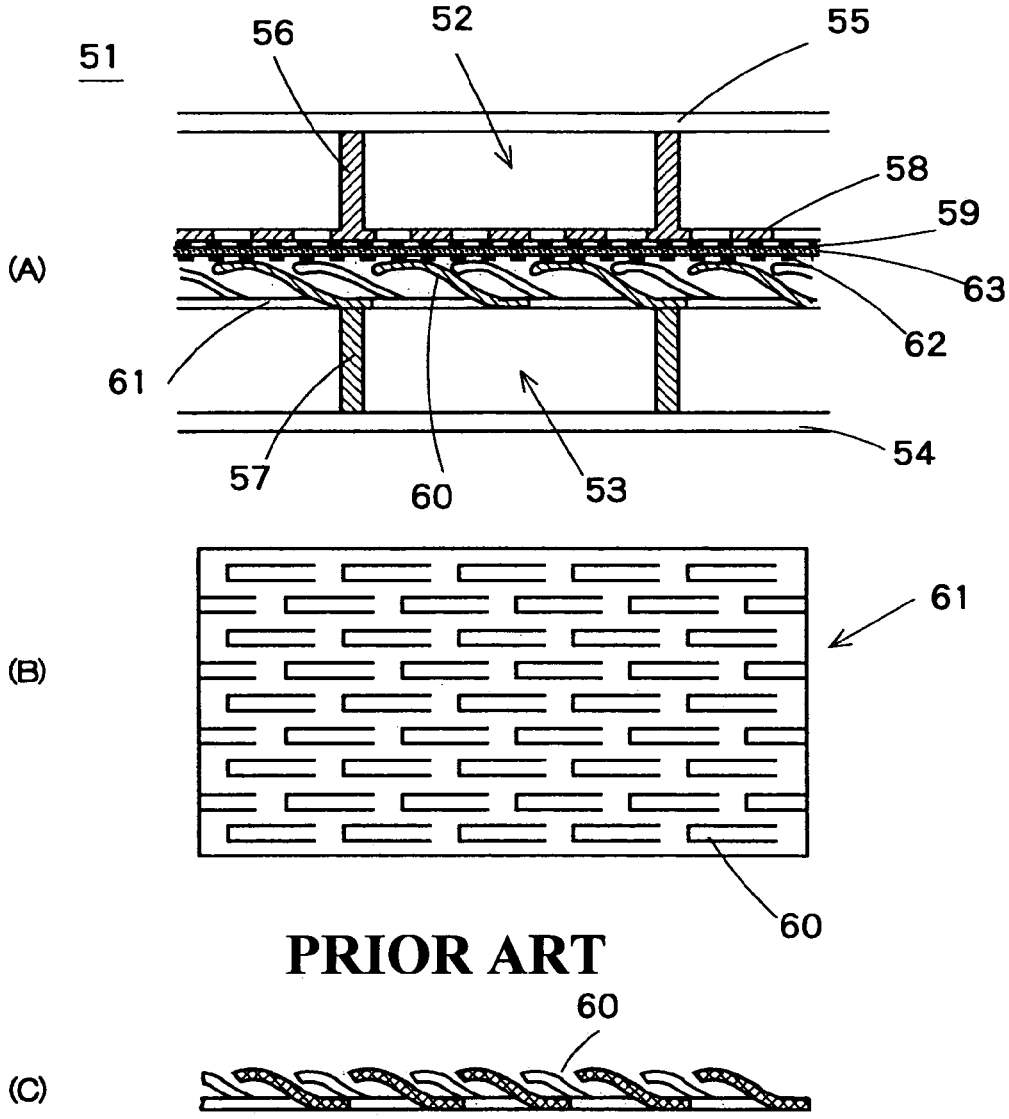
Fig 10 PRIOR ART
FIGS. 10(A), 10(B) and 10(C) are illustrative of a prior art electrolyzer provided with flat leaf spring tags.

FIGS. 9(A) and 9(B) are illustrative of a further embodiment of the present invention, wherein flat leaf spring tags are attached to a unipolar electrolyzer.

FIG. 9(A) is a partly cut-away view of an electrolyzer unit for a filter press type unipolar electrolyzer, and FIG. 9(B) is a sectional view taken on line C–C' of FIG. 9(A).

More specifically, FIGS. 9(A) and 9(B) are illustrative of a further embodiment of the present invention, wherein an electric conductor 33 is engaged with a framework 32 of a unipolar electrolyzer unit 31 that defines a cathode chamber. The conductor 33 comprises an electrolyte has a downward flow path for an electrolyte therein, makes an electric connection with a cathode side collector 34, and comprises an electrolyte-circulating, electric current feeding means 35 for retaining the cathode side collector 34.

The cathode side collector 34 is formed of a porous member such as expanded metal, and has such a structure that allows an electrolyte to freely flow through the interior of the electrolyzer unit. A flat leaf spring form of retainer member 12 having a number of flat leaf spring tags 11 formed thereon is joined to the cathode side collector 34. The flat leaf spring tags 11 come into contact with a cathode 8 to make electric connections thereto, and enable the electrode to be adjusted perpendicularly to the electrode surface.

When the flat leaf spring tags 11 are provided on the flat leaf spring form of retainer member 12, the area of an opening 28 formed by punching-out is so enlarged that when the retainer member 12 is attached to the cathode side collector 34, the electrolyte can flow through the opening 28 in the retainer member 12.

In the electrolyzer, the air bubble-containing electrolyte goes up along the electrode surface, arriving at a top portion of the electrolyzer, where gases are separated from the electrolyte. Then, the thus separated electrolyte goes down through the electrolyte-circulating, electric current feeding means 35, and is subjected to electrolysis in the electrolyzer together with a cathode fluid fed through a cathode fluid feed pipe 36 and a cathode fluid feed nozzle 37, after which the fluid is discharged from the electrolyzer through a cathode fluid discharge port 38.

While this embodiment has been described with reference to the flat leaf spring tags and retainer member located on the cathode side, it is understood that they may be located on the anode side.

When they are located on the cathode side, they may be formed of nickel, nickel alloys, stainless steel or the like, which are well resistant to an environment prevailing within the cathode chamber, and the cathode may be formed of nickel, a porous or network member of nickel alloys, or expanded metal. These cathode substrates may be coated on their surfaces with an electrode catalyst substance coating such as a platinum-group metal containing layer, a Raney nickel-containing layer, and an active carbon-containing nickel layer thereby lowering hydrogen overvoltage.

When the flat leaf spring tags and retainer member are located on the anode side, they may be formed of a thin-film forming metal such as titanium, tantalum or zirconium or their alloys, and the anode may be formed of a thin-film forming metal such as titanium, tantalum or zirconium or their alloys. These anode substrates may be coated on their surfaces with an electrode catalyst substance coating such as a coating containing a platinum-group metal or its oxide.

Although the size of each flat leaf spring tag is determined depending on the electrode areas of the electrolyzer, etc., the flat leaf spring tag may have a thickness of 0.2 mm to 0.5 mm, a width of 2 mm to 10 mm, and a length of 20 mm to 50 mm.

When the electrolyzer of the present invention is used for electrolysis of an aqueous solution of alkaline metal halides, e.g., brine, saturated brine is fed to the anode chamber while water or a dilute aqueous solution of sodium hydroxide is supplied to the cathode chamber. After electrolysis at a given electrolytic rate, the product is taken out of the electrolyzer.

Electrolysis of brine in the ion exchange membrane electrolyzer is carried out while the pressure of the cathode chamber is kept higher than that of the anode chamber, and the electrolyzer is operated while the ion exchange member is in close contact with the anode. It is then possible to perform electrolysis while the cathode comes close to the ion exchange membrane surface by a given distance since the cathode is retained in place by the flexible flat leaf spring tags. Even upon pressure on the anode chamber side increasing when anything unusual happens, the electrolyzer can be operated while the flat leaf spring tags are kept at a given spacing after removal of pressure, because the flat leaf spring tags have large restoring force.

In the ion exchange membrane electrolyzer of the present invention, at least one of the electrodes is retained in place by the flat leaf spring tags extending in mutually opposite directions. It is thus possible to keep the electrodes at a given spacing without lateral displacements of the electrodes in the surface direction. Even when the electrode is forced from the opposite electrode with unusually increasing pressure, the ion exchange membrane electrolyzer can be operated because the electrode restores back to the original state after removal of pressure.

What is claimed is:

1. An ion exchange membrane electrolyzer, in which an electric current is passed through at least one electrode while said electrode is in contact with a plurality of comb-like flat leaf spring tags extending at an angle from a flat leaf spring form of retainer member located on an electrode partition provided in an electrode chamber, wherein each pair of comb-like flat leaf spring tags are arranged in such a way that adjacent flat leaf spring tags extend in mutually opposite directions.

2. The ion exchange membrane electrolyzer according to claim 1, wherein each pair of comb-like flat leaf spring tags extending in mutually opposite directions have the same length.

3. The ion exchange membrane electrolyzer according to claim 1, wherein the flat leaf spring tags comprise abutments bent at tips toward the flat leaf spring form of retainer member, which abutments are in contact with the electrode.

4. The ion exchange membrane electrolyzer according to claim 1, wherein openings are found on a surface of the flat leaf spring form of retainer member onto which a comb-like flat spring tag arrangement is projected, and a land portion of the retainer member is found on a surface of the retainer member onto which adjacent flat spring tags are projected.

5. The ion exchange membrane electrolyzer according to claim 1, wherein openings are found on a surface of the flat leaf spring form of retainer member onto which a comb-like flat spring tag arrangement is projected, and a land portion of the retainer member is found on a surface of the retainer member onto which adjacent sets of flat leaf spring tags are projected.

6. The ion exchange membrane electrolyzer according to claim 1, wherein the flat leaf spring form of retainer member is joined at a belt-like junction to a flat plate form of electrode chamber partition in a parallel relation thereto, thereby defining a space between the retainer member and the electrode chamber partition, said space being used as a downward flow path for an electrolyte, and an upward flow path for the electrolyte is formed on an electrode side.

7. The ion exchange membrane electrolyzer according to claim 2, wherein the flat leaf spring form of retainer member with the flat leaf spring tags attached thereto is joined at a belt-like junction to a flat plate form of electrode chamber partition in a parallel relation thereto, thereby defining a space between the retainer member and the electrode chamber partition, said space being used as a downward flow path for an electrolyte, and an upward flow path for the electrolyte is formed on an electrode side.

8. The ion exchange membrane electrolyzer according to claim 1, wherein the flat leaf spring form of retainer member with the flat leaf spring tags attached thereto is joined to a porous member having an opening a diameter of which is larger than the electrode that the flat leaf spring tags contact.

9. The ion exchange membrane electrolyzer according to claim 2, wherein the flat leaf spring form of retainer member with the flat leaf spring tags attached thereto is joined to a porous member having an opening a diameter of which is larger than the electrode that the flat leaf spring tags contact.

10. The ion exchange membrane electrolyzer according to claim 3, wherein the flat leaf spring form of retainer member with the flat leaf spring tags attached thereto is joined to a porous member having an opening a diameter of which is larger than the electrode that the flat leaf spring tags contact.

* * * * *